United States Patent [19]

Tetreault

[11] Patent Number: 4,671,508

[45] Date of Patent: Jun. 9, 1987

[54] PRACTICE BAT

[76] Inventor: Albert G. Tetreault, 1541 Conejo La., Fullerton, Calif. 92632

[21] Appl. No.: 826,809

[22] Filed: Feb. 6, 1986

[51] Int. Cl.[4] ..... A63B 59/06

[52] U.S. Cl. ..... 273/26 B; 273/186 A; 273/29 A

[58] Field of Search ..... 273/26 B, 29 A, 183 D, 273/194 B, 67 DB, 72 R, 72 A, 73 J, 75, 81 R, 81 A, 81 D, 165, 81.2, 187 R, 186 A, 170

[56] References Cited

U.S. PATENT DOCUMENTS

| | | | |
|---|---|---|---|
| 514,420 | 2/1894 | Jacobus | 273/72 R |
| 2,379,006 | 6/1945 | Johnson | 273/72 R |
| 3,116,926 | 1/1964 | Owen et al. | 273/26 B |
| 3,137,504 | 6/1964 | Zordan et al. | 273/26 B |
| 3,578,808 | 5/1971 | Piazza | 273/26 B |
| 3,762,720 | 10/1973 | Jett | 273/183 D |
| 3,806,130 | 6/1977 | Jacques | 273/183 D |
| 3,897,058 | 7/1975 | Koch | 273/26 B |
| 3,931,968 | 1/1976 | Hedberg | 273/81.2 |
| 4,027,879 | 6/1977 | Wright | 273/183 D |
| 4,113,248 | 9/1978 | Yanagioka | 272/72 A |

*Primary Examiner*—Richard C. Pinkham
*Assistant Examiner*—T. Brown
*Attorney, Agent, or Firm*—Edgar W. Averill, Jr.

[57] ABSTRACT

A practice bat for improving the swing of a bat used in a game such as baseball. The bat is hollow and has a moveable weight which moves between the handle end and the striking end of the bat. The weight may be held in the handle end by the squeezing of the top hand of the user's grip and, thus, is not properly released. In a relaxed grip, however, the swing of the bat causes the weight to move outwardly to strike the striking end of the bat. Preferably, the weight is held by making a portion of the handle end of the bat deformable so that it can be moved to press against the weight and hold it at the handle end.

14 Claims, 8 Drawing Figures

PRACTICE BAT

BACKGROUND OF THE INVENTION

The field of the invention is sporting goods and the invention relates more particularly to devices used for improving the proficiency of one who plays the sport. While the drawings and discussion, herein, will center on the game of baseball and the swinging of a baseball bat, the concept of the present invention is useful for other sports such as golf or tennis.

Weighted bats have been used for many years, such bats being commonly used by a player who is about to enter the game as a hitter. For instance, in baseball, the batter waiting in the on-deck circle, commonly swings a weighted bat or several bats together so that the bat he will use in the game will feel lighter and quicker in his hands. The most common type of weight used in the on-deck circle is a doughnut-shaped weight which is slipped over the handle end of the bat and is restrained at its inner periphery by the widened portion of the bat.

While such weighted bat serves a useful purpose in loosening up the batter prior to hitting, it does not have any significant benefit in training the batter's hand-gripping action and there is, thus, a need for a device which provides training and practice in the gripping of a bat during a swing.

SUMMARY OF THE INVENTION

It is an object of the present invention to provide a training device for a batter useful to improve the gripping and swinging of a bat to improve the batter's proficiency.

The present invention is for a practice bat for improving the swing of a bat used in a game. The practice bat includes a hollow bat, having a handle end and a striking end. A movable weight is located within the hollow bat and moves freely under the influence of gravity from within the handle end to within the striking end and back to the handle end. Preferably, releasable weight grasping means are located in the handle end of the bat and are operable by at least one of the hands of the batter. The releasable weight grasping means has sufficient force to hold the weight at the handle end while the bat is being swung and is capable of being released by movement of at least one of the user's hands during the swing to permit centrifugal force to move the weight outwardly along the bat so that its upper end impacts the striking end of the bat. Preferably, the bat is a hollow aluminum alloy bat and has a weight guide tube longitudinally positioned therein so that the weight is guided along the longitudinal axis of the bat. In a preferred embodiment, the releasable weight grasping means comprises a plurality of slits in the handle of the bat which permit the handle to be depressed and to contact and hold the weight while it is gripped at the handle end.

DESCRIPTION OF THE PREFERRED EMBODIMENTS

Figures 1, 2, 3, 4, 5, 6, 7, 8:
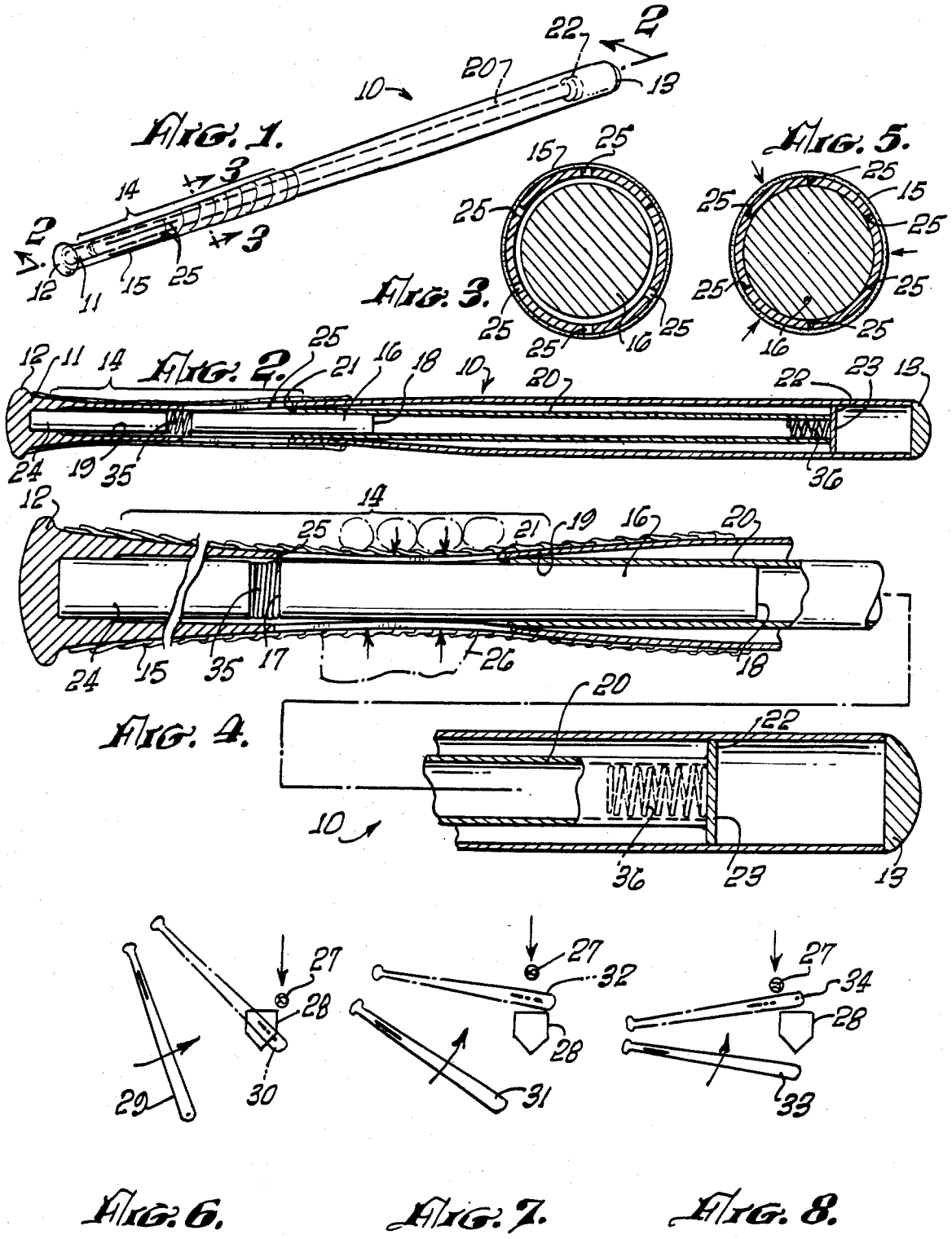
FIG. 1 is a perspective view of the practice bat of the present invention showing the movable weight and weight guide tube in phantom line.
FIG. 2 is an enlarged cross-sectional view taken along line 2—2 of FIG. 1.
FIG. 3 is an enlarged cross-sectional view taken along line 3—3 of FIG. 1.
FIG. 4 is an enlarged cross-sectional view of the bat of FIG. 1 showing the gripping action of the top hand of a batter.
FIG. 5 is a cross-sectional view showing the handle portion of the bat as it is being gripped and deformed against the movable weight thereof.
FIG. 6 is a top diagrammatic view showing the movement of the weight in the bat of FIG. 1.
FIG. 7 is a top diagrammatic view showing the movement of the weight in the bat of FIG. 1.
FIG. 8 is a top diagrammatic view showing the movement of the weight in the bat of FIG. 1.

The practice bat of the present invention is shown in perspective view in FIG. 1 and indicated generally by reference character 10. Bat 10 has a handle end 11 including a knob 12 and a striking end 13. The handle of the bat extends a distance from handle end 11 which is indicated generally by reference character 14. Handle 14 is wrapped with a flexible deformable tape such as leather, rubber or plastic and is indicated generally by reference character 15.

The inner construction of the bat is shown best in FIG. 2 where it can be seen that a weight 16 has an inner end 17 and an outer end 18 and can move freely, not only in the inner portion 19 of handle 14, but also along the inside of longitudinally affixed weight guide tube 20. Weight guide tube 20 is affixed at its inner end 21 to the inner portion 19 of the handle and at its outer portion 22 to an impact disk 23 which is welded or otherwise affixed near the striking end 13 of the bat. The spot at which the impact disk 23 is positioned is an important aspect of the present invention. It should be located at a position so that it is impacted by the weight at the instant that maximum speed and power of the swing is reached. Using a weight of 11.88 inches long, it has been found that placing the weight about six inches from striking end 13 has proved satisfactory.

It has been found that a hollow bat made from an aluminum alloy has been particularly useful in the practice of the present invention, and an impact disk 23 made from an aluminum alloy, three-quarter inch thick, welded to the end of an aluminum weight guide tube and to the inside surface of the aluminum bat has proved a reliable combination. A rod or plug 24 is pinned or otherwise affixed at the handle end 11 of the bat and holds the weight away from the handle end at its innermost position. This plug reduces the travel distance of the weight during a swing and also assists in distributing the impact of the weight against the handle end of the bat. The striking end 13 is preferably formed from an aluminum disk which has been rounded by grinding as shown in FIGS. 2 and 4. Preferably a pair of springs 35 and 36 help to cushion the impact of weight 16 against impact disk 23 and plug 24. Springs 35 and 36 are preferably helical springs which move freely between the ends of the weight 16 and the ends of the compartment where the weight travels.

An important feature of the present invention is the means by which the weight is restrained during a swing. One particularly simple and effective manner of teaching a hitter not to grip the bat too tightly during a swing is to provide means to restrain the weight if the hitter is making this mistake. The means used in the bat shown in the drawings is the provision of a plurality of slits 25 which extend along a portion of the handle 14 as shown best in FIG. 2. As shown in FIGS. 4 and 5, when the user's upper hand 26 grips the handle portion of the bat at the area including slits 25, the area of the bat handle between the slits moves inwardly and into contact with weight 15. The slits should be long enough to permit the metal strip between the slits to be readily deformed. Six slits of about six inches in length has proved very satisfactory. This deflection of the strips between the slits, of course, holds the weight at its inner position until the grip is relaxed, or until the centrifugal force is so great as to prevent any further holding of the weight. When upper hand 26 is relaxed during the swing of a bat, weight 15 rapidly moves outwardly by centrifugal force and its outer end 18 strikes impact sring 36.

As indicated in FIGS. 6, 7 and 8, the weight strikes the impact disk at different times depending upon the swing of the batter. Because of the length of travel between the outer end 18 and the impact disk 23, the time the weight 16 takes to travel from the handle end to the point of impact with the impact disk closely approximates the time it takes the bat to reach maximum speed, extension and power. The noise and feel of impact is vividly felt by the batter and, thus, the batter is now given an objective sign of this point of maximum power. By watching the bat during the swing, the batter can now see where his point of maximum impact is and can get immediate reinforcement of a proper swing. The point in the swing for maximum power is different depending upon the direction that the batter wishes to hit the ball and also depending upon whether the ball is an inside or outside pitch. An attempt has been made to illustrate this in the drawings. The baseball 27 and the plate 28 are used in the drawings only to indicate the direction of swing since the practice bat of the present invention is not used to contact the ball, but only in a practice swing.

In FIG. 6, the lower bat shown in phantom lines and indicated by reference character 29 indicates the position of start of movement of the weight which then strikes the impact disk, as indicated at the position shown at reference character 30, which is the desirable contact point for hitting the baseball toward right field. In FIG. 7, the position of start of movement is indicated by reference character 31 causing the weight to strike the impact disk at the position indicated by reference character 32 which will train a hitter to hit with maximum power in the direction of center field. In FIG. 8, the start of movement position is indicated at 33 which would cause a striking of the impact disk with the weight at position 34 training a hitter to hit with maximum power in the direction of left field.

It has been found that the swinging of practice bat 10 is an exercise which holds the player's interest and causes him to concentrate on his grip and swing of the bat. This has been shown to improve a player's ability to more accurately hit with maximum power in a desired direction. It can also be used to build strength in a player's hands and forearms by the squeezing of the handle to deliberately restrain the weight.

While the means used to restrain the weight of the present invention has been shown as a plurality of six longitudinal slits, as indicated in FIG. 5, other gripping means could be used such as one or more deformable buttons in the handle area which could be made to contact the weight when gripped. While the present invention has been described in conjunction with an aluminum alloy bat, other materials of construction could alternatively be used. While six slits are shown in the drawings, two or more slits could readily be used. It has been found that placing the means for releasing the weight in conjunction with the top or outer hand for some sports, such as baseball, is beneficial. For other sports, or even for baseball, the gripping area could be placed with the inner, lower or handle end hand for improving the grip and movement of the inner hand.

An aluminum alloy bat having six slits was made using a twenty-two and one-half ounce steel rod, having an outside diameter of three-quarters of an inch and a length of eleven and one-half inches. Such a weight is believed ideal for professional ball players and provides a practice bat having an overall weight of about sixty-three ounces. For Little League players, a weight more in the range of twelve to fourteen ounces is believed preferable.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A practice bat for improving the swing of a player in a game, said practice bat comprising:

a hollow bat having a handle portion and a handle end in said handle portion, a striking portion and a striking end in said striking portion;

a movable weight located within said hollow bat, said weight being freely movable under the influence of gravity from within the handle end to within the striking end back to the handle end, said weight having an inner end facing the handle end and an outer end facing the striking end, the outside dimensions of which, closely but freely, fit within the handle portion of the bat; and releasable weight grasping means located in the handle portion of the bat, said releasable weight grasping means being operable by at least one of the hands of a player using said bat, said weight being held in the handle portion by the grip of said grasping means by a player while the bat is being swung and being released by the relaxing of a batter's grip during a swing, to permit centrifugal force to move said weight from said handle portion so that said weight will impact said striking end of the bat.

2. The practice bat of claim 1 wherein said practice bat is a hollow aluminum alloy bat.

3. The practice of claim 1 wherein said releasable weight grasping means comprises a plurality of generally longitudinal flexible strips defined by slits in the wall of the handle portion of the bat, said strips being of sufficient flexibility to cause said handle to be inwardly deformed by the grip of a user of said bat and wherein said movable weight is movable into that portion of the handle end adjacent said slits and strips and said movable weight is contactable by the handle portion of the bat when the handle portion is deformed inwardly by the grip of a user.

4. The practice bat of claim 3 wherein there are at least four slits.

5. The practice bat of claim 1 further including a stop plug in the handle end of the bat to limit the inward movement of the weight when it is allowed to move freely toward the handle end.

6. The practice bat of claim 1 further including a stop plate affixed to the interior of the hollow bat near said striking end.

7. The practice of claim 1 wherein said weight is generally cylindrical and further including a cylindrical weight guide tube longitudinally held within said hollow bat to hold the weight near the longitudinal center of the bat, said cylindrical weight guide tube having an inside diameter slightly larger than the outside diameter of said weight.

8. A practice bat for improving the swing of a baesball player, said practice bat comprising:

a hollow aluminum alloy baseball bat having a handle end and a striking end, said bat having a hollow cylindrical weight guide longitudinally positioned within substantially one-half of said bat, said one-half including said striking end, the hollow of said guide being in communication with the hollow of said handle end a generally cylindrical weight movably located within said hollow bat and guide, said weight being freely movable under the influence of gravity from within the handle end to within said guide and to said striking end and back to said handle end, said weight having an outside diameter which closely, but freely, fits within the handle end and guide; and releasable weight grasping means located in said handle end of the bat, said releasable weight grasping means comprising a plurality of longitudinal flexible strips defined by slits through at least a portion of the handle end and said grasping means being operable by a batter applying pressure to said handle end, said weight at the handle end by the grip of a batter against said strips while the bat is being swung and being releasable by the relaxing of the grip of a batter during a swing to permit centrifugal force to move said weight from the handle end of the striking end.

9. The practice bat of claim 8 further including wrapping tape means surrounding said handle portion.

10. The practice bat of claim 9 wherein there are six of said slits.

11. The practice bat of claim 8 wherein said bat further including an elongated plug extending along a portion of said handle end, said plug being a stop for said weight when said weight when said weight moves from said striking end to said handle end.

12. The practice bat of claim 8 wherein said weight weighs about twenty-two ounces.

13. The practice bat of claim 8 further including a helical spring positioned between the striking end of the bat and the movable weight.

14. The practice bat of claim 8 further including a helical spring postioned between the handle end of the bat and the movable weight.

* * * * *